US007539454B2

(12) United States Patent
Nishikawa

(10) Patent No.: US 7,539,454 B2
(45) Date of Patent: May 26, 2009

(54) PRINTING APPARATUS AND PRINTING METHOD

(75) Inventor: Fumikazu Nishikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/700,938

(22) Filed: Feb. 1, 2007

(65) Prior Publication Data

US 2007/0189830 A1 Aug. 16, 2007

(30) Foreign Application Priority Data

Feb. 15, 2006 (JP) ..... 2006-038484

(51) Int. Cl.
*G03G 15/00* (2006.01)
*G03G 21/00* (2006.01)

(52) U.S. Cl. ..... 399/392; 399/393

(58) Field of Classification Search ..... 400/70, 400/76, 578, 582, 624, 625; 399/392, 393
See application file for complete search history.

(56) References Cited

U.S. PATENT DOCUMENTS

| | | | | |
|---|---|---|---|---|
| 5,781,842 | A * | 7/1998 | Ito et al. | 399/382 |
| 5,816,716 | A * | 10/1998 | Sugiyama | 400/76 |
| 6,304,342 | B1 * | 10/2001 | Komada | 358/448 |
| 7,061,637 | B2 * | 6/2006 | Mochimaru et al. | 358/1.15 |
| 7,103,760 | B1 * | 9/2006 | Billington et al. | 713/1 |
| 7,317,882 | B2 * | 1/2008 | Dombrowski | 399/81 |
| 7,349,644 | B2 * | 3/2008 | Morikawa | 399/81 |
| 7,408,674 | B2 * | 8/2008 | Moro et al. | 358/1.9 |
| 2005/0213154 | A1 * | 9/2005 | Narusawa et al. | 358/1.18 |
| 2006/0002752 | A1 * | 1/2006 | Ebuchi | 400/76 |
| 2006/0018697 | A1 * | 1/2006 | Takahashi | 400/76 |
| 2006/0062621 | A1 * | 3/2006 | Saida | 400/76 |
| 2006/0127149 | A1 * | 6/2006 | Togashi et al. | 399/392 |

FOREIGN PATENT DOCUMENTS

| | | | |
|---|---|---|---|
| JP | 08160693 | A * | 6/1996 |
| JP | 09152813 | A * | 6/1997 |
| JP | 2003262994 | | 9/2003 |
| JP | 2003262994 | A * | 9/2003 |

* cited by examiner

*Primary Examiner*—Jill E Culler
*Assistant Examiner*—'Wyn' Q Ha
(74) *Attorney, Agent, or Firm*—Fitzpatrick, Cella, Harper & Scinto

(57) ABSTRACT

In a conventional printing apparatus with a plurality of paper feed ports, since a paper type limits the paper feed port usable for paper feed, a user must know in advance a paper feed port to set a paper sheet. This arrangement is not user-friendly. A printing apparatus according to the present invention, however, holds table information indicating the correspondence between paper types and paper feed ports usable for paper feed. When a paper type is designated together with input print data, information on a paper feed port usable for paper feed is acquired from the table information. A message is displayed to prompt the user to set a paper sheet on the paper feed port usable for paper feed so that the user can set an appropriate paper sheet.

10 Claims, 9 Drawing Sheets

FIG. 6

| PAPER TYPE | MANUAL FEED TRAY USABLE FOR PAPER FEED |
|---|---|
| PLAIN PAPER | FRONT |
| COATED PAPER | FRONT |
| GLOSSY PAPER | FRONT |
| HIGH-QUALITY DEDICATED PAPER | FRONT |
| CARDBOARD | BACK |

PRINTING APPARATUS AND PRINTING METHOD

BACKGROUND OF THE INVENTION

1. Field of the Invention

The present invention relates to a printing apparatus and printing method. Particularly, the present invention relates to a printing apparatus and printing method which bitmap information transferred from a host computer via an interface into image information and print the image on a print medium by, e.g., an inkjet printing method.

2. Description of the Related Art

Conventionally, a printing apparatus for printing an image on a print medium (e.g., print paper sheet) by an electrophotographic method or inkjet printing method includes a data input unit which inputs external data, an image bitmapping unit which bitmaps the input data into an image, and a print unit which prints on a print medium. There is also an arrangement that inputs an image bitmapped externally in advance and directly prints the input image on a print medium.

Examples of a connection between the printing apparatus and an external device are parallel connection, USB connection, and network connection. Especially, network connection allows a plurality of host computers to share a single apparatus. Hence, a printing apparatus connectable to a network is becoming a standard.

Examples of external input data are image data transmitted from an externally connected host computer or digital camera, and document and image files stored in a storage medium such as a flash memory. The image bitmapping unit bitmaps data into an image with a format printable by an electrophotographic method or inkjet printing method.

Such a printing apparatus (to be also referred to as an image forming apparatus) generally includes a controller and an engine unit. External input information is input in a language format that describes the arrangement and expression method of texts and images. The controller analyzes the language and bitmaps the information into a bitmap format. On the other hand, the engine unit receives the image data from the controller and actually prints the image by using a photosensitive drum and an inkjet printhead while conveying a print paper sheet.

Upon language analysis, the controller bitmaps the image and also acquires, from the external input information, various kinds of setting information including the size and type of the print paper sheet, the number of print pages, and the print quality. The controller further acquires various kinds of information about the print process, which are set via an operation panel provided on the printing apparatus, determines final print control information, and notifies the engine unit of it together with the externally input setting information.

The engine unit conveys a print paper sheet and prints on it by using an inkjet printhead (to be referred to as a printhead hereinafter). Scan of the printhead is executed in the following way.

A print paper sheet stored in a feed cassette or feed tray is conveyed until its leading edge comes to the printable position of the printhead (this procedure will be referred to as paper feed hereinafter). After paper feed, one print paper sheet is printed by repeating printing by the printhead and conveyance of the print paper sheet. After printing, the print paper sheet is discharged to the paper discharge port of the apparatus. To print a plurality of pages, paper feed, print, and paper discharge are repeated a number of times equal to the number of pages.

To reliably print on a designated kind of paper sheets on the basis of externally input print data, some apparatuses detect the type of paper sheets set in the feed cassettes and feed paper sheets from a paper feed port with the paper type designated on the basis of the detection result. Some apparatuses can set paper types for a plurality of paper feed ports instead of detecting the paper types, and feed paper sheets from a paper feed port with the designated paper type (e.g., Japanese Patent Application Laid-Open No. 2003-262994).

The prior arts have the following problems.

If an apparatus has a plurality of paper feed ports, and the paper type limits the paper feed port usable for paper feed, the user must know in advance a paper feed port to set a paper sheet. Especially when printing should be done by, e.g., manual paper feed, i.e., by setting different kinds of paper sheets many times one by one, it is difficult for the user to grasp paper feed ports usable to feed all kinds of paper sheets. This arrangement is not user-friendly.

SUMMARY OF THE INVENTION

Accordingly, the present invention is conceived as a response to the above-described disadvantages of the conventional art.

For example, a printing apparatus according to this invention is capable of executing high-speed print and user-friendly for a plurality of users.

According to one aspect of the present invention, preferably, there is provided a printing apparatus which feeds plural kinds of print media and prints an image on the fed print medium, comprising: a plurality of feed means for feeding the print media via different channels; storage means for storing a table that indicates a correspondence between print medium types and the plurality of feed means; input means for inputting, from an external apparatus, print data and a type of print medium to be used for print; selection means for selecting appropriate feed means from the plurality of feed means on the basis of the print medium type input by the input means and the table stored in the storage means; display means for displaying a message to prompt a user to set a print medium on the selected feed means on the basis of a selection result of the selection means; confirmation means for confirming whether or not the print medium is set in accordance with the message displayed on the display means; and print means for printing an image on the set print medium by using the print data input by the input means on the basis of a confirmation result of the confirmation means.

According to another aspect of the present invention, preferably, there is provided a printing method of a printing apparatus which includes a plurality of feed means for feeding plural kinds of print media via different channels and prints an image on the print medium fed by any one of the plurality of feed means, comprising steps of: storing a table that indicates a correspondence between print medium types and the plurality of feed means; inputting, from an external apparatus, print data and a type of print medium to be used for print; selecting appropriate feed means from the plurality of feed means on the basis of the table and the print medium type input in the input step; displaying a message to prompt a user to set a print medium on the selected feed means on the basis of a selection result in the selection step; confirming whether or not the print medium is set in accordance with the message displayed in the display step; and printing an image on the set print medium by using the input print data on the basis of a confirmation result in the confirmation means.

The invention is particularly advantageous since even when the apparatus has a plurality of feed means corresponding to the print medium types, and the type limits the feed means usable for paper feed, a message notifies the user of the feed means to set a print medium. The user only needs to set a print medium in accordance with the message displayed on the apparatus. Hence, the user can easily set an appropriate print medium.

Particularly when the apparatus is used in a network environment, the printing apparatus is often distant from the host apparatus. Since the printing apparatus displays an appropriate message even under this environment, the user can properly operate the apparatus without any operation error. This contributes to improving user-friendliness of the apparatus.

Further features of the present invention will become apparent from the following description of exemplary embodiments (with reference to the attached drawings).

BRIEF DESCRIPTION OF THE DRAWINGS

FIG. 6 is a view showing the contents of a table that indicates the correspondence between paper types and manual feed trays usable for paper feed.

DESCRIPTION OF THE EMBODIMENTS

Preferred embodiments of the present invention will now be described in detail in accordance with the accompanying drawings.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "printing element" (to be also referred to as a "nozzle" hereinafter) generally means a set of a discharge orifice, a liquid channel connected to the orifice and an element to generate energy utilized for ink discharge.

Figure 1:
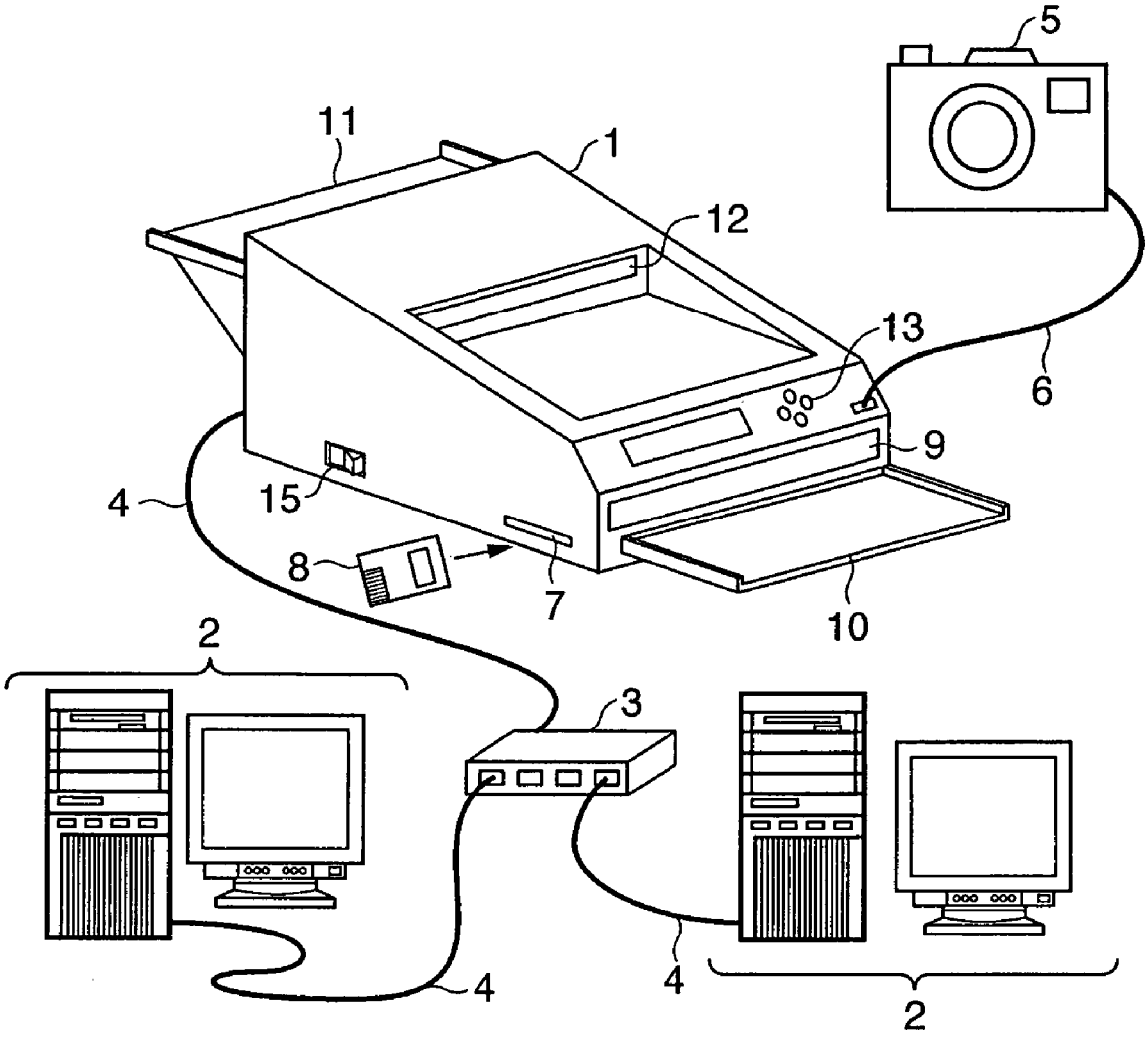
FIG. 1 is a perspective view showing the schematic outer appearance of a printing apparatus (image forming apparatus) according to a typical embodiment of the present invention.

FIG. 1 is a perspective view showing the schematic outer appearance of a printing apparatus (image forming apparatus) according to a typical embodiment of the present invention. FIG. 1 also illustrates various peripheral devices connected to a printing apparatus 1.

The printing apparatus 1 prints an image on a print medium (e.g., print paper sheet) on the basis of information input from the outside or held in the apparatus in advance. As shown in FIG. 1, the printing apparatus 1 connects to two host computers (to be referred to as hosts hereinafter) 2 via a network hub 3 and network cables 4. The hosts 2 transfer, to the printing apparatus 1, print data and information (to be referred to as print information hereinafter) to control the printing apparatus 1. A digital camera 5 also connects to the printing apparatus 1 via a cable 6 and transfers image information to the printing apparatus 1. The printing apparatus 1 has a flash memory insert port 7 to receive a flash memory 8. The printing apparatus 1 can receive print information stored in the flash memory 8.

The printing apparatus 1 comprises a feed cassette 9 capable of setting a predetermined number of print paper sheets, a front manual feed tray 10 that sets paper sheets one by one and feeds them, and a back manual feed tray 11 that feeds paper sheets such as cardboards that are not flexible and hard to bend. A print paper sheet fed from these feed mechanisms is discharged from a paper discharge port 12.

The printing apparatus 1 has an operation key 13 which is used to input various settings about the operation of the printing apparatus 1 or operated to use the printing apparatus 1 in a stand-alone mode. A display panel 14 displays, on its display screen, the state of the printing apparatus 1 or the contents of operation settings input via the operation key 13. The user can also set the print paper sheet type and the print quality by using the operation key 13 and display panel 14. A power switch 15 powers on/off the printing apparatus 1.

Figure 2:
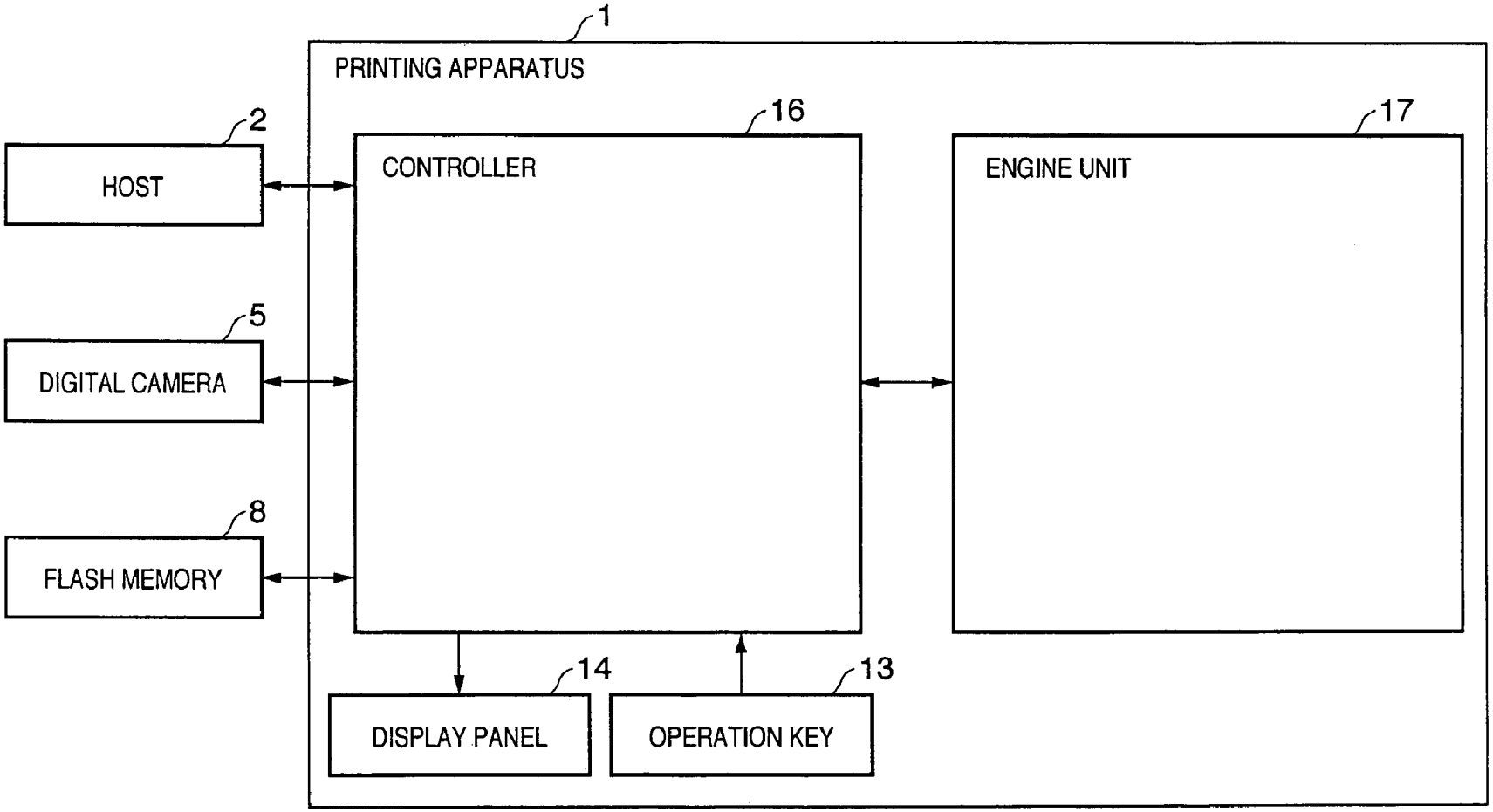
FIG. 2 is a block diagram showing the schematic arrangement of the printing apparatus (image forming apparatus)

FIG. 2 is a block diagram showing the schematic internal arrangement of the printing apparatus 1.

As shown in FIG. 2, the printing apparatus 1 includes a controller 16 and an engine unit 17. The controller 16 receives print information from the hosts 2, digital camera 5, and flash memory 8, and analyzes the information to generate image data with a format printable by the engine unit 17. The controller 16 also receives inputs from the operation key 13 and sets the operation environment of the printing apparatus 1. Additionally, the controller 16 displays, on the display panel 14, the state of the printing apparatus 1 or a message to prompt the user to operate the operation key 13.

The engine unit 17 feeds a print paper sheet, prints an image on it on the basis of the image data generated by the controller 16, and discharges the paper sheet. If an error such as paper jam or paper run out occurs in the engine unit 17, the controller 16 is notified of it. In response to this, the controller 16 displays, on the display panel 14, a message to notify the user of the error or notifies the host 2 or digital camera 5 of the error.

Figure 3:
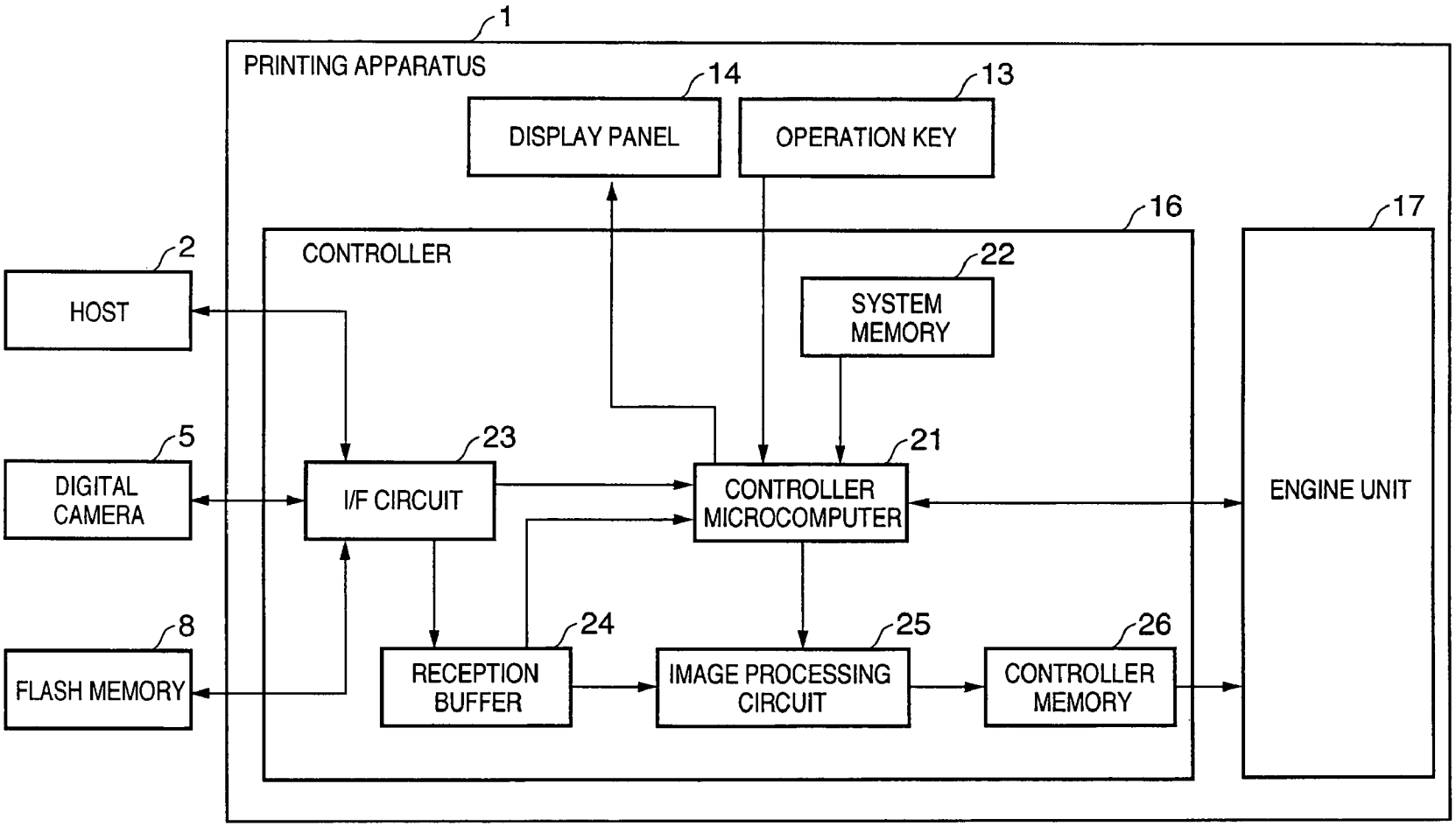
FIG. 3 is a block diagram showing the arrangement of a controller of the printing apparatus (image forming apparatus) shown in FIG. 2.

FIG. 3 is a block diagram showing the internal arrangement of the controller 16 of the printing apparatus 1.

Referring to FIG. 3, reference numeral 21 denotes a controller microcomputer; 22, a system memory; 23, an interface circuit (to be referred to as an I/F circuit hereinafter); 24, a reception buffer; 25, an image processing circuit; and 26, a controller memory.

The operation of the controller will be described next.

The controller microcomputer 21 controls all processes including analysis of externally input print information, image processing, and bitmap conversion. The print data flow is as follows.

The reception buffer 24 stores, via the I/F circuit 23, print information input from the host 2, digital camera 5, or flash memory 8. The controller microcomputer 21 is notified of the reception of print information via the I/F circuit 23. The print information contains various kinds of setting information such as the size and type of paper sheets in addition to the image data.

The controller microcomputer 21 analyzes the received print information and sends the analysis result to the image processing circuit 25 and engine unit 17. The image processing circuit 25 reads out the image data stored in the reception buffer 24 and converts it into bitmap image data by image processing. The image data is stored in the controller memory 26 and then sent to the engine unit 17.

The controller microcomputer 21 receives an operation instruction from the operation key 13 and executes processing according to the received instruction. The engine unit 17 notifies the controller microcomputer 21 of the state of print operation and the contents of an error (if it occurs) so that the display panel 14 displays a message, or the host 2 or digital camera 5 is notified of it.

Figure 4:
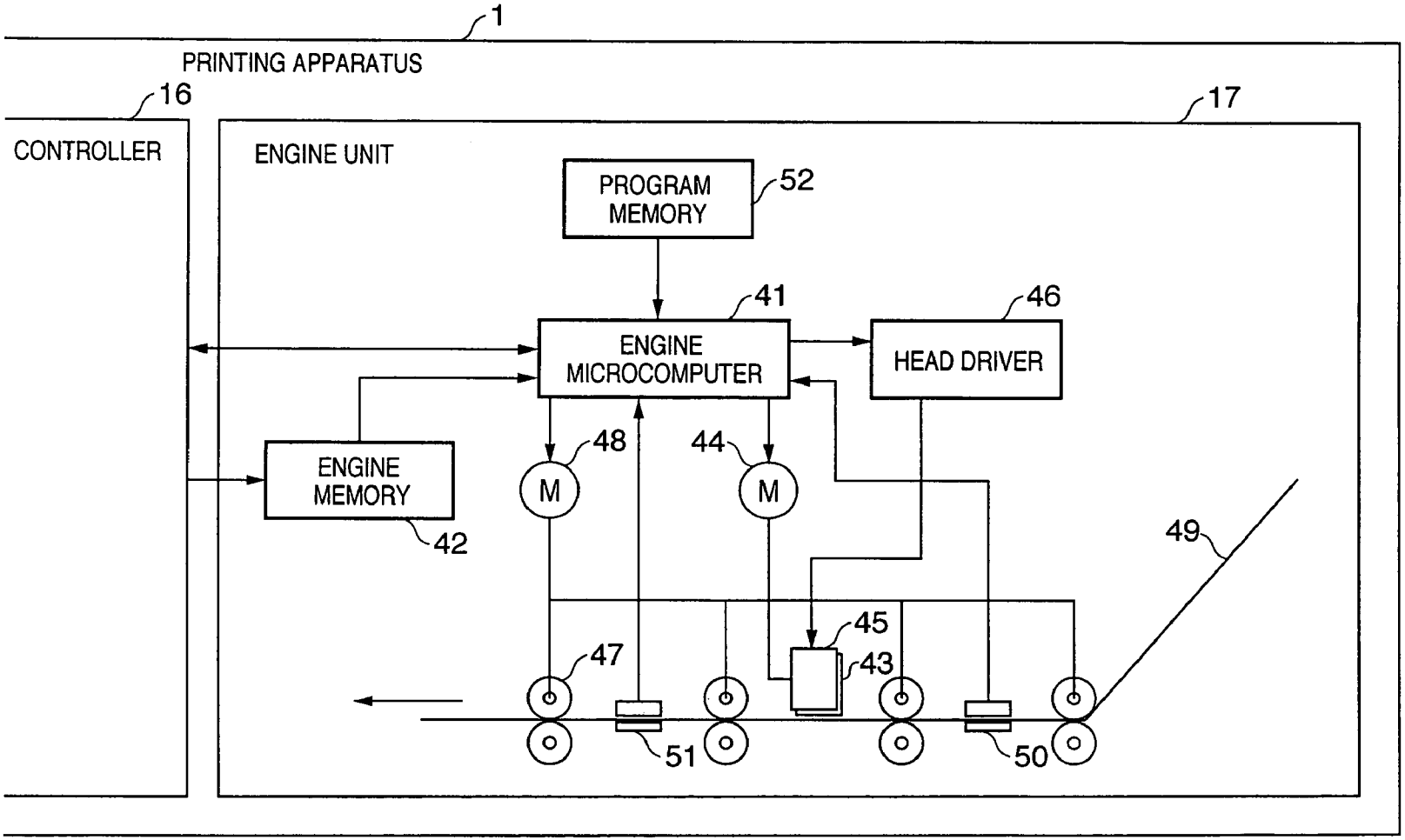
FIG. 4 is a block diagram showing the arrangement of an engine unit of the printing apparatus (image forming apparatus) shown in FIG. 2.

FIG. 4 is a block diagram showing the internal arrangement of the engine unit 17. FIG. 4 shows the arrangement in a side cross section of the printing apparatus 1 viewed from the lateral direction.

Referring to FIG. 4, reference numeral 41 denotes an engine microcomputer; 42, an engine memory; 43, a carriage; 44, a carriage motor; 45, a printhead; 46, a head driver; 47, a conveyance roller; 48, a conveyance motor; 49, a print paper sheet; 50, a paper feed sensor; 51, a paper discharge sensor; and 52, a program memory. The printhead 45 discharges ink according to an inkjet printing method.

The operation of the engine unit 17 will be described next.

The engine microcomputer 41 performs all controls including feed/discharge of the print paper sheet 49 and the printhead. The engine memory 42 stores bitmap image data sent from the controller 16. The print paper sheet 49 is fed/discharged by driving the conveyance motor 48 and rotating the conveyance rollers 47.

Whether feed/discharge is normally performed or not is determined by causing the paper feed sensor 50 and paper discharge sensor 51 to detect the presence/absence of the print paper sheet 49. The head driver 46 drives and controls scan of the carriage 43 to which the printhead 45 is mounted. The carriage motor 44 reciprocally moves the carriage 43 in a direction perpendicular to the drawing surface and the conveyance direction of the print paper sheet 49. During the reciprocal movement, the printhead 45 discharges ink droplets to the print paper sheet 49 to print an image. If the paper feed sensor 50 and paper discharge sensor 51 detect jam of the print paper sheet 49, the engine unit 17 stops printing and notifies the controller 16 of it.

FIG. 4 shows only a single feed path. However, the printing apparatus 1 has three feed channels of the feed cassette 9, front manual feed tray 10, and back manual feed tray 11, as shown in FIG. 1. The rollers 47 perform feed and discharge regardless of which channel is used for feeding a print paper sheet.

Two embodiments of a control operation executed by the printing apparatus with the above-described arrangement will be described next.

First Embodiment

Figure 5A:
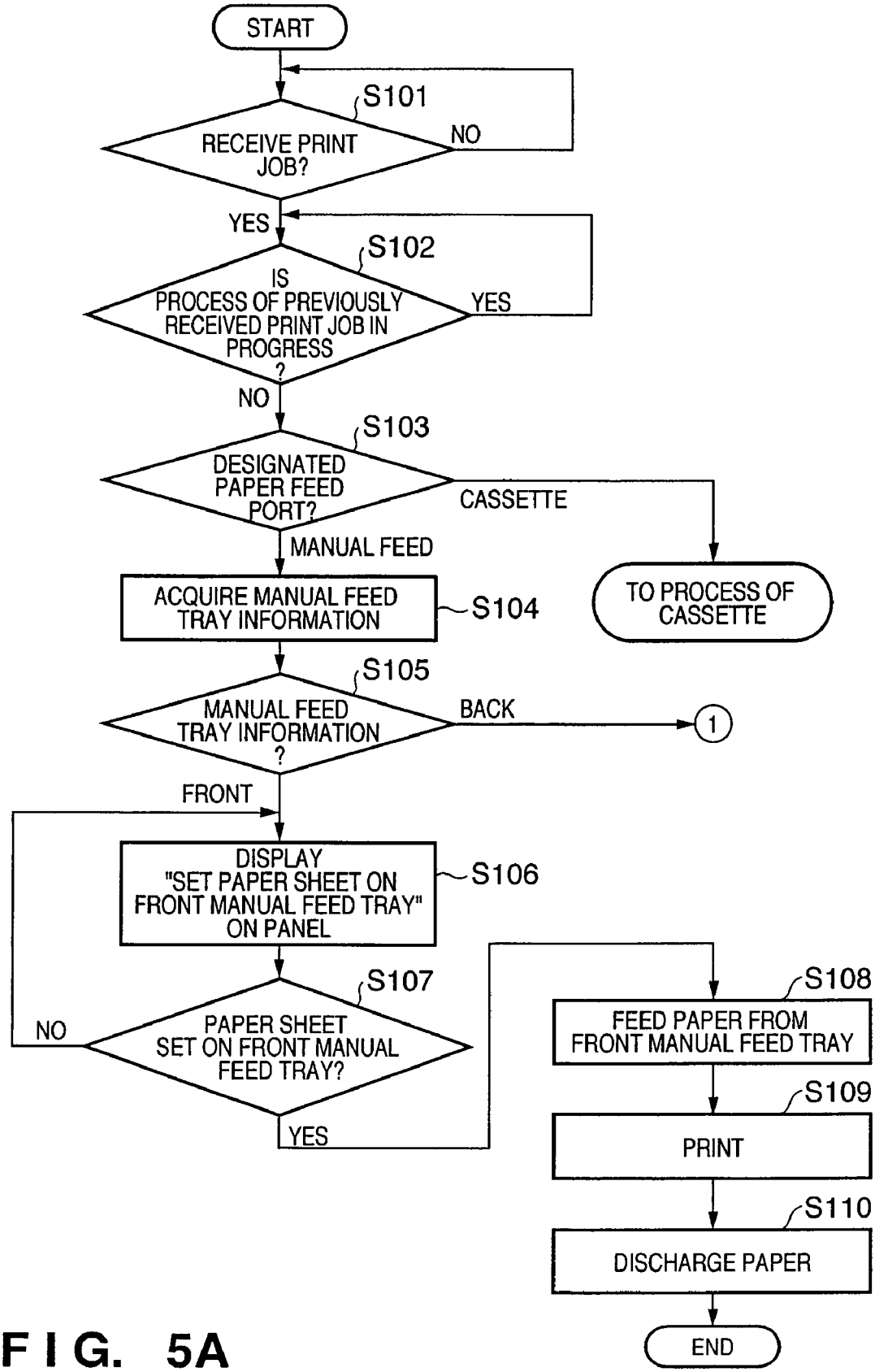
FIGS. 5A and 5B are flowcharts showing an operation according to the first embodiment.
Figure 5B:
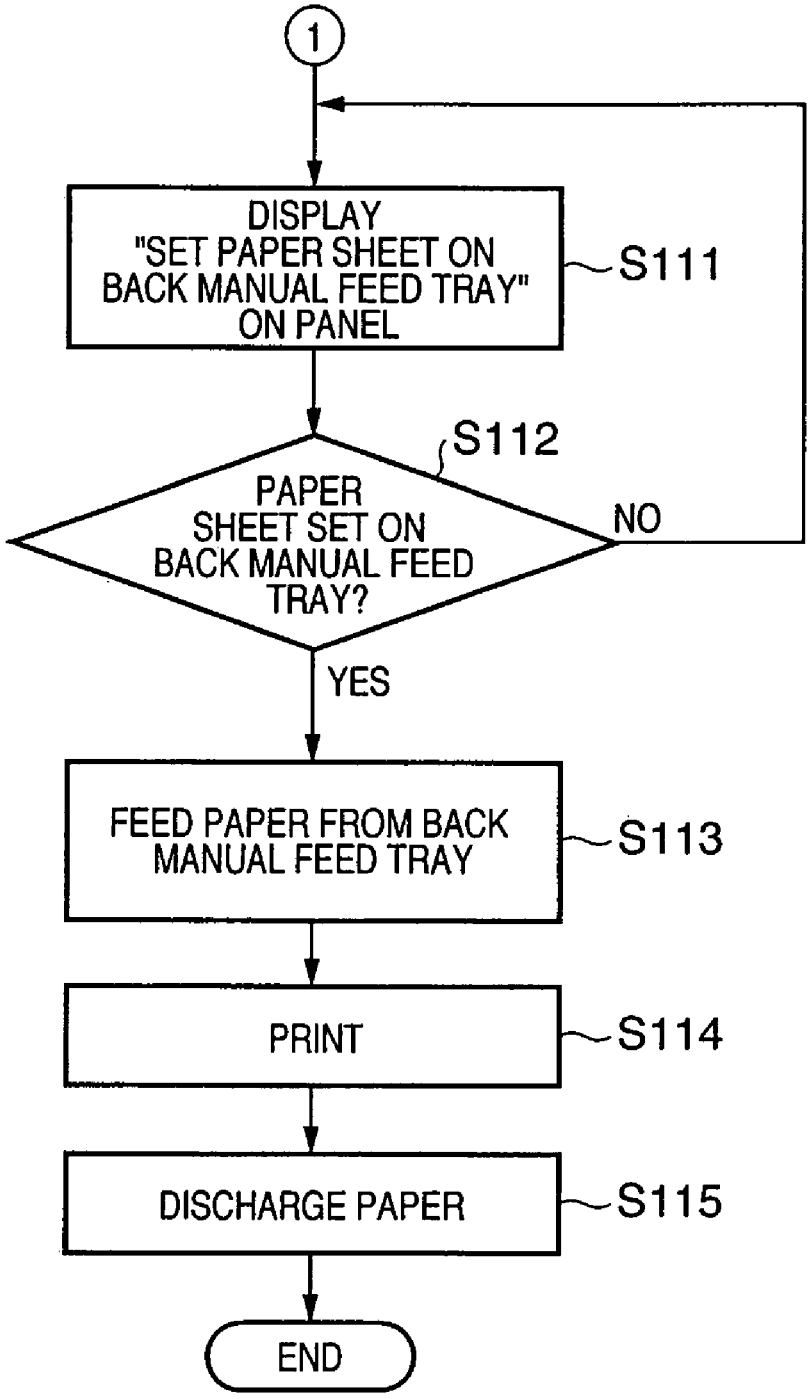

FIGS. 5A and 5B are flowcharts showing an operation according to the first embodiment.

A program to implement the operations in these flowcharts is incorporated in the system memory 22 and the program memory 52 and executed by the controller microcomputer 21 and the engine microcomputer 41. The controller microcomputer 21 and engine microcomputer 41 execute the control operation cooperatively in accordance with the flowcharts shown in FIGS. 5A and 5B.

FIGS. 5A and 5B show a process upon receiving a print job from a host.

The process will be described below in accordance with each step of the flowcharts.

In step S101, reception of a print job from the host 2, digital camera 5, or flash memory 8 is waited. If a print job is received, the controller microcomputer 21 is notified of it from the I/F circuit 23. The reception buffer 24 stores the received information.

In step S102, it is checked whether or not a process of a previously received print job is in progress. If YES in step S102, the end of process is waited. Upon confirming the end of the previously received job, the process advances to step S103 to confirm which paper feed port is designated by the print job. If a manual feed tray is designated, the process advances to step S104. If a cassette is designated, the process advances to the process of the cassette. Feed from a cassette is performed according to a well-known technique, and a description thereof will be omitted.

In step S104, information of a manual feed tray usable for paper feed is acquired from the paper type designated by the print job.

FIG. 6 is a view showing the contents of a table that indicates the correspondence between paper types and manual feed trays usable for paper feed. The system memory 22 holds the table shown in FIG. 6.

Whether the manual feed tray usable for paper feed is the front manual feed tray 10 or the back manual feed tray 11 is determined on the basis of the paper type designated by the print job. In this embodiment, as shown in FIG. 6, when paper other than "cardboard" is designated, paper sheets are fed from the front manual feed tray 10.

In step S105, the manual feed tray information acquired in step S104 is checked on the basis of the above-described condition. If it is determined on the basis of the information that the manual feed tray usable for paper feed is the front manual feed tray 10, the process advances to step S106. If it is determined that the manual feed tray usable for paper feed is the back manual feed tray 11, the process advances to step S111.

In step S106, the display panel 14 displays a message "set a paper sheet on the front manual feed tray" to prompt the user to set a paper sheet on the front manual feed tray 10. In step S107, paper set on the front manual feed tray 10 is waited. If the paper sheet is set, the process advances to step S108.

In step S108, the conveyance motor 48 and conveyance rollers 47 convey and feed the set paper sheet. In step S109, an image is printed on the basis of image data transferred to the engine unit.

More specifically, the image processing circuit 25 processes the print data stored in the reception buffer 24 of the controller 16. The bitmap image data is stored in the controller memory 26 and then transferred to the engine unit 17. The engine memory 42 stores the transferred bitmap image data. The engine unit 17 causes the conveyance motor 48 and the conveyance roller 47 to convey the print paper sheet 49 fed from the front manual feed tray 10. The engine unit 17 also causes the printhead 45 to discharge ink and print an image on the print paper sheet 49 while causing the carriage motor 44 to reciprocally move the carriage 43. The print position of the print paper sheet 49 is controlled in the conveyance direction of the print paper sheet on the basis of the driving amount of the conveyance motor 48 and the detection results of the paper feed sensor 50 and the paper discharge sensor 51. The print position is controlled in the moving direction of the carriage 43 on the basis of the driving amount of the carriage motor 44.

In step S110, the printed paper sheet is discharged from a paper discharge port 12, thereby completing the process of the print job.

On the other hand, if the manual feed tray usable for paper feed is the back manual feed tray 11, the process in steps S111 to S115 is performed as in steps S106 to S110. Note that in step S111, the display panel 14 displays a message "set a paper sheet on the back manual feed tray".

The above-described process will be summarized below.

A print job is received in step S101. The process waits until the previously received print job ends in step S102. Whether the paper feed port is a cassette or a manual feed tray is determined in step S103. If the paper feed port is a manual feed tray, table information is acquired in step S104 to determine on the basis of the paper type which manual feed tray, the front manual feed tray or back manual feed tray, is usable for paper feed. The determination is made in step S105. In a case where the front manual feed tray is used, the process in steps S106 to S110 is executed. In a case where the back manual feed tray is used, the process in steps S111 to S115 is executed. For both the front and back manual feed trays, the display panel displays a message to prompt the user to set a paper sheet on the intended manual feed tray. Then, the set paper sheet is fed, printed, and discharged, thus completing the process.

According to the above-described embodiment, a message to notify the user of which manual feed tray (i.e., the front or back manual feed tray) to set a paper sheet is displayed. Thus, the user need not know in advance which manual feed tray should be used to set a paper sheet for print. In addition, it is advantageous since the user can set a paper sheet at a proper timing.

Hence, it is only necessary to set "manual feed" to designate the paper feed port on the external device (e.g., host) at the time of print data transmission. In other words, it is unnecessary to select either the front manual feed tray or back manual feed tray. The user need not be aware of the manual feed tray, i.e., the front or back manual feed tray used for paper feed. She/he only needs to set a paper sheet in accordance with the displayed message. Hence, a user-friendly apparatus can be obtained.

Particularly when the printing apparatus 1 is used in a network-connected environment, a plurality of users may simultaneously transmit print data to the printing apparatus 1. Even in this environment, since the display panel 14 of the printing apparatus 1 displays the operation guide, each user can properly and easily execute print by setting paper sheets according to the operation guide. As a result, the operability of the printing apparatus 1 improves.

Second Embodiment

Figure 7A:
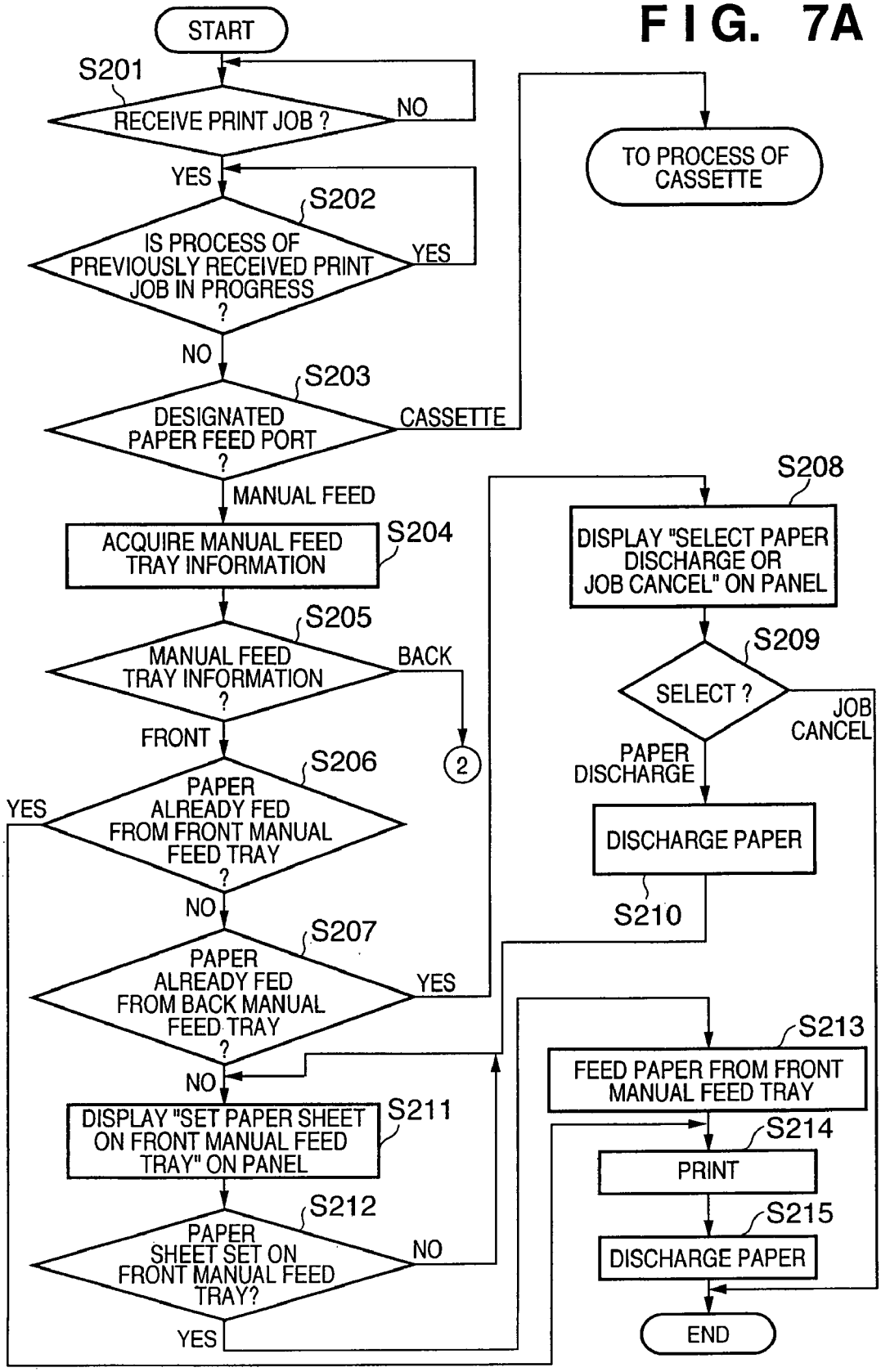
FIGS. 7A and 7B are flowcharts showing an operation according to the second embodiment.
Figure 7B:
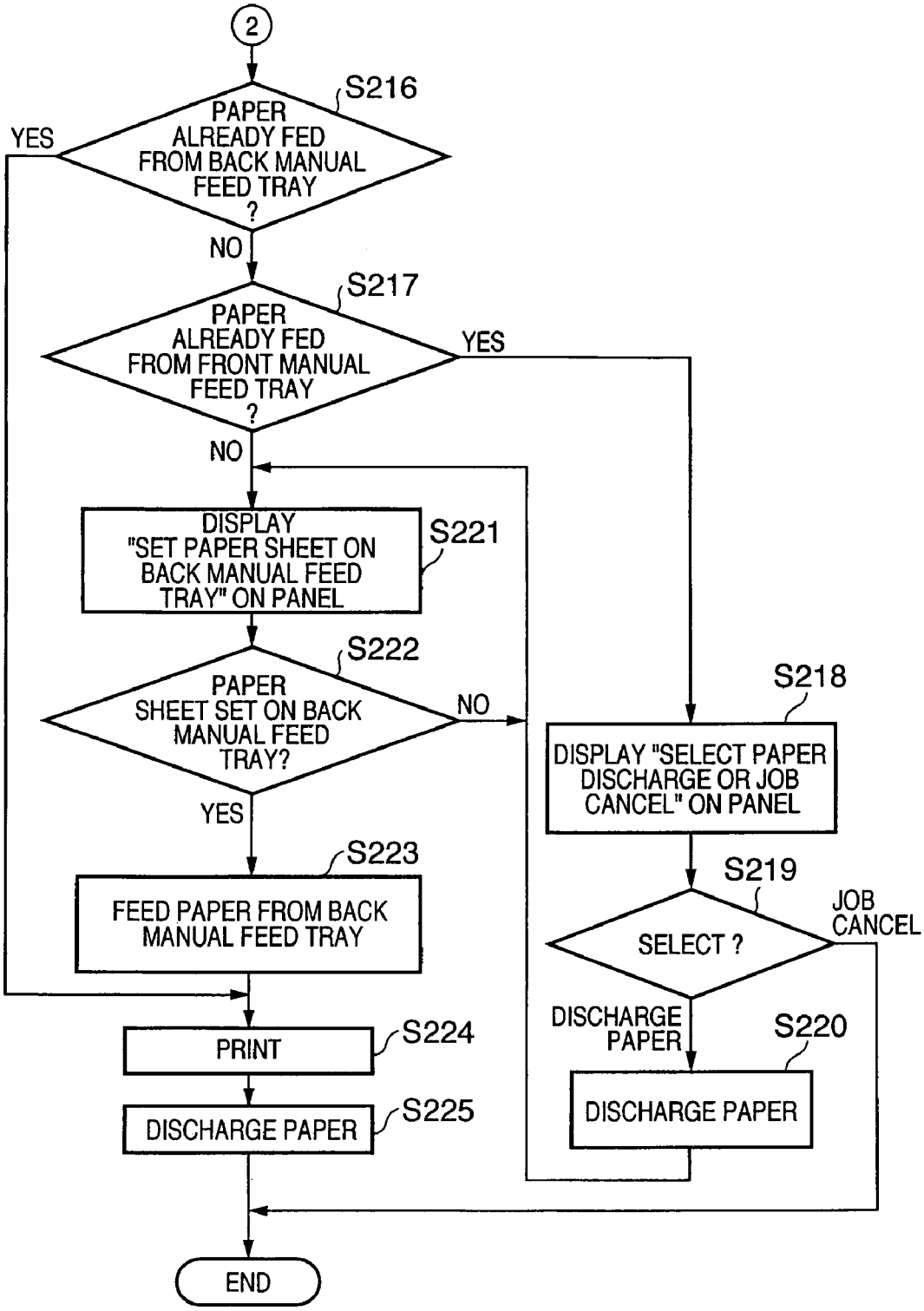

FIGS. 7A and 7B are flowcharts showing an operation according to the second embodiment.

A program to implement the operations in these flowcharts shown in FIGS. 7A and 7B is also incorporated in the system memory 22 and the program memory 52 and executed by the controller microcomputer 21 and the engine microcomputer 41, as in the first embodiment. The controller microcomputer 21 and engine microcomputer 41 execute the control operation cooperatively in accordance with the flowcharts shown in FIGS. 7A and 7B.

FIGS. 7A and 7B show a process executed when a paper sheet has already been fed from a manual feed tray, in addition to the process of the first embodiment.

The process will be described below in accordance with each step of the flowcharts.

The process in steps S201 to S205 is the same as in steps S101 to S105 of the first embodiment, and a description thereof will be omitted.

In step S206, it is determined whether or not a paper sheet has already been fed from the front manual feed tray 10. If YES in step S206, the process advances to step S214. If NO in step S206, the process advances to step S207. In step S207, it is determined whether or not a paper sheet has already been fed from the back manual feed tray 11. If YES in step S207, the process advances to step S208. If NO in step S207, the process advances to step S211.

In step S208, the display panel 14 displays a message "select paper discharge or job cancel" to prompt the user to select paper discharge or job cancel. This selection is made via the operation key 13. In step S209, the instruction selected by the user is checked. If the user selects "job cancel", the process of the received job terminates. If the user selects "paper discharge", the process advances to step S210 to discharge the paper sheet fed from the back manual feed tray 11 to the paper discharge port 12. After that, the process advances to step S211.

The process in steps S211 to S215 is the same as in steps S106 to S110 of the first embodiment, and a description thereof will be omitted.

If it is determined in step S205 that the manual feed tray usable for paper feed is the back manual feed tray 11, the process in steps S216 to S225 is executed. The process in steps S216 to S225 is basically the same as in steps S206 to S215 described above except that the presence/absence of paper feed from the front manual feed tray and that from the back manual feed tray are determined in a reverse order. The process in steps S221 to S225 is the same as in steps S111 to S115 of the first embodiment.

In the above-described process, if it is determined in step S206 that a paper sheet has already been fed from the front manual feed tray 10, paper feed from the front manual feed tray 10 in step S211 to S213 is unnecessary. Hence, the process advances to step S214 to execute control to start the print process. If it is determined din step S207 that a paper sheet has already been fed from the back manual feed tray 11, the paper feed port is different from that (=front manual feed tray 10) based on the paper type designated by the print job. Hence, the user needs to select "paper discharge" or "job cancel" in step S208 to S210. If the user selects "paper discharge", she/he is prompted to newly set a paper sheet to be fed on the front manual feed tray 10 after paper discharge.

Similarly, if it is determined in step S216 that a paper sheet has already been fed from the back manual feed tray 11, paper feed from the back manual feed tray 11 in step S221 to S223 is unnecessary. Hence, the process advances to step S224 to execute control to start the print process. If it is determined in step S217 that a paper sheet has already been fed from the front manual feed tray 10, the paper feed port is different from that (=back manual feed tray 11) based on the paper type designated by the print job. Hence, the user needs to select "paper discharge" or "job cancel" in step S218 to S220. If the user selects "paper discharge", she/he is prompted to newly set a paper sheet to be fed on the back manual feed tray 11 after paper discharge.

According to the above-described embodiment, print immediately starts if a paper sheet has already been fed from the paper feed port determined by the paper type. This shortens the time until the completion of print.

If a paper sheet has already been fed from a paper feed port different from that determined by the paper type, printing is suspended, and the user is prompted to select "job cancel" or "paper feed" from a correct paper feed port. This prevents printing on an incorrect kind of paper sheets.

In the above-described embodiments, droplets discharged from the printhead are ink droplets, and the liquid stored in the ink tank is ink. However, the liquid stored is not limited to ink. For example, a kind of process liquid which is discharged to a print medium to increase the fixing effect and water repellency of a printed image or increase the image quality may be stored in the ink tank.

In the above-described embodiments, particularly when, of inkjet printing systems, a system which comprises means (e.g., an electrothermal transducer) for generating heat energy for ink discharge and changes the ink state by the heat energy is used, the printing density and resolution can be increased.

In the above-described embodiments, a serial scan type inkjet printing apparatus has been exemplified. However, the present invention is not limited to this and can also effectively be applied to an inkjet printing apparatus using a full line type printhead having a print length corresponding to the maximum width of a print medium printable by the apparatus. Such printhead may take a structure which meets this length by combining a plurality of printheads or a single integrated printhead structure.

The above-described engine unit uses a printhead based on the inkjet printing method. However, the engine unit may have a print mechanism based on any other printing method such as an electrophotographic method, thermal transfer method, or sublimation method.

The inkjet printing apparatus of the present invention is used as an image output device of an information processing equipment such as a computer. The printing apparatus can also take the form of a copying apparatus combined with a reader, or a facsimile apparatus having a transmission/reception function.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-38484, filed Feb. 15, 2006, which is hereby incorporated by reference herein in its entirety.

What is claimed is:

1. A printing apparatus which feeds plural kinds of print media and prints an image on the fed print medium, comprising:

a plurality of feed means for feeding the print media via different channels;

storage means for storing a table that indicates a correspondence between print medium types and said plurality of feed means;

input means for inputting, from an external apparatus, print data and a type of print medium to be used for print;

selection means for selecting appropriate feed means from said plurality of feed means on the basis of the print medium type input by said input means and the table stored in said storage means;

display means for displaying a message to prompt a user to set a print medium on the selected feed means on the basis of a selection result of said selection means;

confirmation means for confirming that the print medium is set in accordance with the message displayed on said display means;

print means for printing an image on the set print medium by using the print data input by said input means on the basis of a confirmation result of said confirmation means; and print control means for controlling to cause said print means whether or not to print on the basis of a confirmation result if it is further confirmed by said confirmation means that any one of said plurality of feed means has already fed a print medium.

2. The apparatus according to claim 1, wherein said confirmation means further confirms that the appropriate feed means selected by said selection means has already fed a print medium, and said display means further displays, on the basis of the confirmantion result, a message to prompt the user to discharge the currently fed print medium, and otherwise, to cancel a print operation based on the print data input by said input means.

3. The apparatus according to claim 2, further comprising instruction reception means for receiving a user's instruction corresponding to the message, wherein said print control means controls to cancel the print operation if the user's instruction received by said instruction reception means indicates cancel of the print operation.

4. The apparatus according to claim 3, wherein said print control means controls to discharge the currently fed print medium if the user's instruction received by said instruction reception means indicates paper discharge.

5. The apparatus according to claim 4, wherein said print control means controls said display means to display a message to prompt the user to feed a print medium from the appropriate feed means after paper discharge.

6. The apparatus according to claim 1, wherein, when newly inputting print data by said input means, said print control means waits for a process based on the newly input print data if said print means is executing the print operation on the basis of previously input print data.

7. The apparatus according to claim 1, wherein the external apparatus includes a host computer, a digital camera, and a flash memory.

8. The apparatus according to claim 7, further comprising communication interface means for connecting the host computer via a network.

9. A printing apparatus which feeds plural kinds of print media and prints an image on the fed print medium, comprising;

a plurality of feed means for feeding the print media via different channels:

storage means for storing a table that indicates a correspondence between print medium types and said plurality of feed means;

input means for inputting, from an external apparatus, print data and a type of print medium to be used for print;

selection means for selecting appropriate feed means from said plurality of feed means on the basis of the print medium type input by said input means and the table stored in said storage means;

display means for displaying a message to prompt a user to set a print medium on the selected feed means on the basis of a selection result of said selection means;

confirmation means for confirming that the print medium is set in accordance with the message displayed on said display means; and print means for printing an image on the set print medium by using the print data input by said input means on the basis of a confirmation result of said confirmation means, wherein said plurality of feed means include:

first feed means for feeding a print medium from a cassette having print media stacked;

second feed means for feeding a print medium from a tray provided on a front surface of the printing apparatus; and third feed means for feeding a print medium from a tray provided on a back surface of the printing apparatus.

10. A printing method of a printing apparatus which includes a plurality of feed means for feeding plural kinds of print media via different channels and prints an image on the print medium fed by any one of the plurality of feed means, comprising steps of:

storing a table that indicates a correspondence between print medium types and the plurality of feed means;

inputting, from an external apparatus, print data and a type of print medium to be used for print;

selecting appropriate feed means from the plurality of feed means on the basis of the table and the print medium type input in the input step;

displaying a message to prompt a user to set a print medium on the selected feed means on the basis of a selection result in the selection step;

confirming that the print medium is set in accordance with the message displayed in the display step;

printing an image on the set print medium by using the input print data on the basis of a confirmation result in the confirmation step; and controlling to cause said step of printing whether or not to print on the basis of a confirmation result if it is further confirmed in the confirmation step that any one of the plurality of feed means has already fed a print medium.

* * * * *